US006073666A

United States Patent [19]

Clark, II

[11] Patent Number: 6,073,666

[45] Date of Patent: Jun. 13, 2000

[54] AUTOMATED FLUID DISPENSING AND COLLECTING DEVICE

[75] Inventor: James E. Clark, II, Ojai, Calif.

[73] Assignee: C. H. & I. Technologies, Inc., Santa Paula, Calif.

[21] Appl. No.: 09/194,537

[22] PCT Filed: May 20, 1996

[86] PCT No.: PCT/US96/07641

§ 371 Date: Oct. 26, 1999

§ 102(e) Date: Oct. 26, 1999

[87] PCT Pub. No.: WO97/44244

PCT Pub. Date: Nov. 27, 1997

[51] Int. Cl.[7] ..... B65B 1/04

[52] U.S. Cl. ..... 141/83; 141/94; 141/65; 184/1.5

[58] Field of Search ..... 141/83, 65, 66, 141/67, 98, 59, 94, 95; 184/1.5

[56] References Cited

U.S. PATENT DOCUMENTS 4,938,315 7/1990 Ohta et al. ..... 184/1.5

5,586,583 12/1996 Edwards et al. ..... 141/83

*Primary Examiner*—Steven O. Douglas

*Attorney, Agent, or Firm*—Christie, Parker & Hale, LLP

[57] ABSTRACT

A portable automated fluid collecting and dispensing unit (10) for the collection of used fluid and for the delivery of new fluid to a fluid utilizing device, such as motor (44). The device (10) includes a tank arrangement (12) having a used fluid tank (14) for collecting and storing used fluid and a new fluid tank (16) for storing and delivering new fluid. The new and used fluid tanks (14 and 16) are dedicated to contain only more particular fluid. A cart (16) carries the tank arrangement (12), and has load cells (26) for determining changes in weight of the tank arrangement (12) and any used fluid and new fluid contained therein. A display (58) indicates any said change in weight of said tank arrangement (12) and any fluid contained therein. The system can also include a stationary primary system (120) for use in recharging the portable device (10), without any intervening cleaning of the device.

18 Claims, 6 Drawing Sheets

AUTOMATED FLUID DISPENSING AND COLLECTING DEVICE

BACKGROUND OF THE INVENTION

1. Field of the Invention

This invention relates to the field of fluid dispensing and collecting devices and systems, and more particular to a device and method for collecting a quantity of used fluid and delivering a like quantity of new fluid by use of a weighing mechanism in lieu of volume measurements, wherein neither the collection of such used fluids nor the delivery of new fluids requires the cleaning of the devices after each use, and is accomplished in a safe and effective manner.

2. Description of the Prior Art

Mechanical, electrical, and other devices utilize a variety of fluids which must be replaced periodically. These devices include vehicles, machinery, transformers, and the like, and the fluids include lubricating oils and greases, cooling fluids, insulating fluids, and other kinds of fluids. Under present practices, after the fluids are utilized beyond their useful life, they are collected from the device in an unsegregated and unsealed manner into bulk drums or tanks. Not only are different kinds of the same category of fluids commingled, but various different fluids are mixed together this way, i.e. motor oil and transmission fluid. For example, different viscosity and additive package motor oils by different manufacturers typically are collected in common bulk used fluid tanks, and even if other fluids (i.e. coolant and transmission fluids) are managed to be kept out, resulting in a jumble of cross-mixed fluids of different viscosities and additives. The fact that the various fluids are collected in an unsealed manner virtually insures that further contamination of the used fluids with dirt, dust, water, etc. will occur, as well as increasing the possibility of spillage of the new and used fluids and fire hazards.

The concoction of different used fluids is then pumped out of the drums or bulk tanks, or directly taken in its drums by a used fluid hauler. In the case of partially recyclable fluids, such as motor oil, these used fluids are then delivered to a used fluid recycler, where the used fluid can be purified and recycled. In the case of various oil-based fluids, such as motor oil, the recycler filters them, boils off the volatiles, and sells the resulting product to various end users, e.g. to shippers for use as marine bunker fuel. In contrast with the relatively high price and high quality of the new lubricant oil stocks, the value of such recycled oil is low. Moreover, lubricating oil formulators will not buy these recycled oil because they lack consistency in their physical and chemical properties, which is in part due to the different oil additive packages included in the oil of different manufacturers. An even bigger problem is that the used oil is most often contaminated with other oil based fluids, such as hydraulic fluid and transmission fluid, dirt, dust, grease, and even water and coolants during its collection in unsegregated and unsealed containers. Often the used fluid is collected in an open basins and drums. This not only allows further contaminants to enter the used fluid, but offers little protection against fire hazards, slipping on spilled fluids, and environmental hazards occurring if the used fluid escapes into the environment.

Not only are there purity problems with the resulting used fluids collected by prior art methods, but also problems associated with the cleaning and safety of the containers and equipment used to collect used fluids and deliver new fluids. For example, after the new lubricant containers are delivered to the site and emptied of their contents, they are either discarded, or steam and acid cleaned by a licensed oil container cleaner, and then reused for new oil or delivered to a service station or other site for use in collecting used fluids or other used products. There is substantial expense and deleterious environmental impact associated with the cleaning of new and used fluid containers, and with storing and delivering these containers which are normally neither pressure vessels, nor capable of withstanding severe impact.

There have been numerous attempts to provide simple yet efficient used fluid recovery and delivery systems. U.S. Pat. No. 4,109,831 to Culpepper, et al.; U.S. Pat. No. 2,477,450 to Gray; U.S. Pat. No. 2,552,749 to Tabet; U.S. Pat. No. 2,536,492 to Dunn et al.; U.S. Pat. No. 2,612,289 to Koester; U.S. Pat. No. 3,430,730 to Kitajima; U.S. Pat. No. 4,378,026 to Bauer; and U.S. Pat. No. 4,095,672 to Senese all have attempted to solve the above outlined problems, and have fallen short.

In addition to these problems, there is the issue of how to measure the quantity of fluid collected from and delivered to a fluid utilizing device. The person conducting the fluid change will either know in advance the correct volume of new fluid which will be required (i.e., from a service manual), or will measure the volume of the used fluid collected, and will add a like amount of the new fluid.

Due to the large number of different vehicles, one conducting a fluid change will frequently consult the manual to determine the volume of fluid required. However, sometimes the volume of fluid required, i.e. crankcase oil, is actually different from that listed in the manual due to the addition of oil coolers and/or other changes to the vehicle's motor and cooling system. Another problem is that sometimes due to fluid loss in the device, the amount of used fluid removed will be less than the new fluid required.

The correct volume of new fluid is typically added to a fluid utilizing device by either adding the new fluid from containers having a know volume (i.e. liter bottles of new fluid), or by use of volume flow meters. Volume flow meters are relatively expensive, and again, if the user is unsure of the correct volume of fluid required by the device, the metering will be of little use.

There accordingly remains a need for an efficient, safe, simple, reliable and environmentally sound device and method to collect used fluids from fluid utilizing vehicles, machinery and devices, and replace the used fluids with a like amount of new fluid, without having to know in advance the precise volume of new fluid required.

BRIEF SUMMARY OF THE INVENTION

One object of the invention is to provide a device which reliably collects a used fluid and delivers the same quantity of new fluid to a fluid utilizing device.

Another object of the invention is to provide a device for collecting used fluid from and delivering a like amount of new fluid to a fluid utilizing vehicle, machine or process by weighing in lieu of volume measurements.

Another object of the invention is to provide an fluid change device which delivers used fluid from and delivers new fluid to a fluid utilizing device in a manner which prevents accidental spillage, and in an automated manner.

A further object of the invention is to provide a fluid change device which utilizes vacuum to removed used fluid and compressed inert gas to deliver new fluid.

A further object is to provide an environmentally safe and clean low cost system with a portable (secondary) portion and a stationary (primary) portion. The system allows used fluid recovery and new fluid delivery directly at the site of the vehicle, machinery or device into the portable portion, with emptying of the used fluid and replenishing of the new fluid of the portable portion occurring at the stationary portion. This not only eliminates substantially, or entirely, the cleaning of new fluid drums or other new fluid containers, but results in the collection of more recyclable used fluid streams which are much more consistent in physical/chemical values, and much more valuable to a reformulator. Another advantage afforded by this two section portable/stationary system is that it allows the new and used fluids to be collected and delivered in a quick, clean, and safe manner. The portable portion preferably utilizes the weighing means noted above.

DETAILED DESCRIPTION OF THE INVENTION

Figure 1:
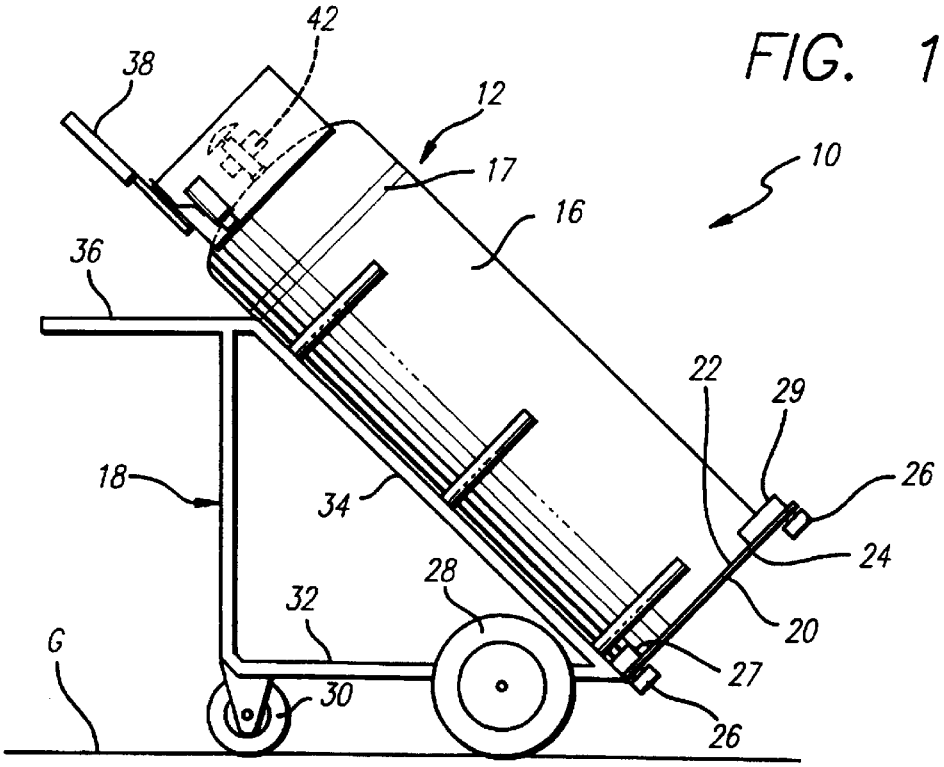
FIG. 1 is a side view of the automated fluid collecting and dispensing device of the invention in its travel mode.
Figure 2:
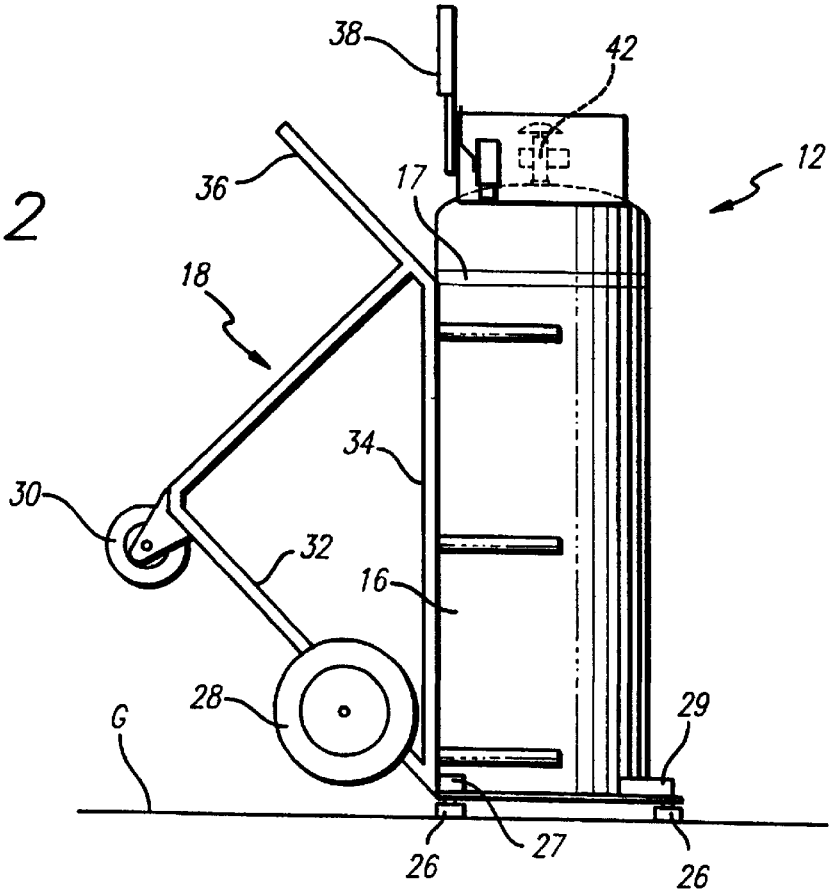
FIG. 2 is a side view of the automated fluid collecting and dispensing device in its weighing mode.
Figure 3:
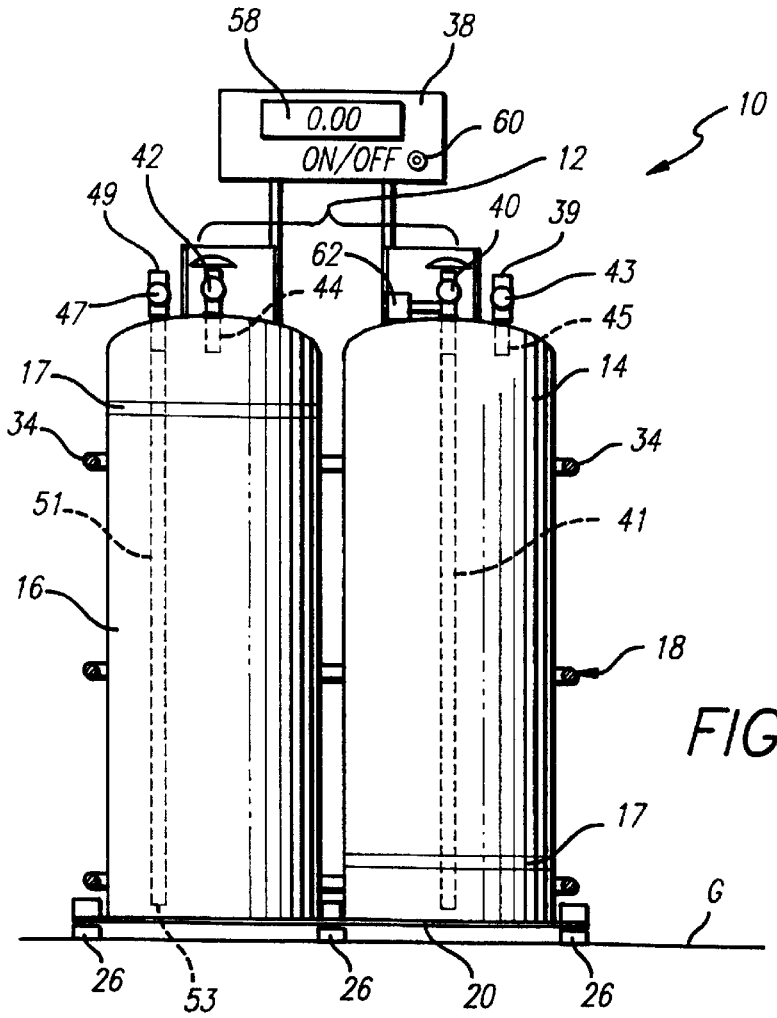
FIG. 3 is a front view of the automated fluid collecting and dispensing device in its weighing mode.

Referring now to FIGS. 1–3, a first embodiment of an automated fluid collecting and dispensing device 10 for the collection of used fluid and for the delivery of new fluid to a fluid utilizing device is shown. The device 10 includes a tank arrangement 12 having a used fluid tank or container 14 for collecting and storing used fluid, and a new fluid tank or container 16 for storing and delivering new fluid. The used and new fluid tanks 14 and 16 comprise sealed pressure tanks. These tanks preferably bear visual indicia such as bar code stamps and/or colored strips 17 to identify their content i.e. new 10–40 wt. Shell motor oil, used 10–40 wt. Shell motor oil, new anti-freeze, used antifreeze, etc. The used fluid tank 14 is adapted to be place under vacuum in order to provide a motive force to move used fluid from the fluid utilizing device, e.g. a motor vehicle, into the used fluid tank 14. The new and used fluid tanks 14 and 16 preferably are U.S. Department of Transportation (D.O.T.) approved pressure vessels, conveniently in the size range of 20 to 30 gallons.

The tank arrangement 12 is carried on a cart 18. The cart 18 has a tank support plate 20 with an upper surface 22 and a lower surface 24. The tank arrangement 12 rests on the upper surface 22. Weight sensing means, such as load cells 26, are positioned on the cart 18 such that they extend below the lower surface 24. Preferably three load cells 26 are used: two on the back 27 and one on the front 29 so that no matter what how uneven the ground surface G is, the full weight of the tank arrangement 12 and its contents will be carried on the load cells 26. The cart 18 has pairs of wheels 28 and 30 carried on wheel support members 32. The wheel support members 32 slant back rearwardly from a tank cradle 34. Handles 36 preferably extend from the back of the cart 18.

In the travel mode of FIG. 1, the cart 18 is tilted back so that the cart 18 rests on the ground G carried on the wheels 28 and 30. To better steer the cart 18, the wheels 30 can preferably swivel. In the travel mode, the tank arrangement 12 will rest against the tank cradle 34, and the load cells 26 do not contact the ground G. Referring to FIG. 2, in the weighing mode, the weight of the cart 18 and the tank arrangement 12 and its contents is carried entirely on the load cells 26 and not on the wheels 28 and 30. The load cells 26 are used to determine any change in weight of said tank arrangement 12 and any used fluid and new fluid contained therein. Display means 38, such as a digital readout, interprets data from the load cells 26 as weight. In addition, the display means 38 can, if the density of the fluids are known, convert weight measurements (e.g. kilograms) into volume measurements (e.g. liters). The display means 38 will increment up as used fluid is drawn into the used fluid tank 14 as measured by the load cells 26, and decrement down as new fluid is delivered from the new fluid tank 16 to the fluid utilizing device as measured by the load cells 26. When a reading of zero on the display means 38 is reached, a user will know that a certain quantity of used fluid has been replaced with a like quantity of new fluid.

Referring to FIG. 3, a used fluid valve 40 is connected to the used fluid tank 14 and a new fluid delivery valve 47 is connected to new fluid tank 16. The used fluid valve 40 has a pipe 41 which extends downwardly near the bottom of the used fluid tank 14 to allow used fluid to be suctioned therefrom, and out through the used fluid valve 40. A second valve 43 with an inlet 39 is also provided for placing a vacuum on the used fluid container 14. It has a short stub pipe 45 which extends a short way into the used fluid container 14 and is used to place a vacuum on the used fluid tank 14. The used fluid tank 14 is delivered to the site of the vehicle in a substantially evacuated vacuum state, so that the used fluids can be quickly drawn into it. A nitrogen fill valve 42 has a short stub pipe 44 extending a short way down into the new fluid tank 16. A new fluid delivery valve 47 has an inlet 49 and a feed pipe 51 which extends downwardly to near the bottom of the new fluid tank 16. The new fluid tank 16 carries a pressurized inert gas, such as nitrogen, which pressurizes the new fluid in the new fluid container 16, and propels it out through the feed pipe 49 and the new fluid delivery valve 47. Since the new fluid exits the tank 16 through the feed pipe 49 near the bottom of the tank 16, the quantity of nitrogen gas will remain substantially unchanged in the new fluid tank 16 as the new fluid in the container 16 is depleted, unless of course, the level of new fluid in the container 16 drops below the level of the inlet 53 of the feed pipe 51. This will not normally occur, however, because as the level of new fluid in the new fluid tank 16 drops, so does the inert gas pressure, and the speed at which the new fluid can be dispensed. This feature will remind the operator that it is time to recharge the new fluid tank 16 with new fluid.

Figure 4:
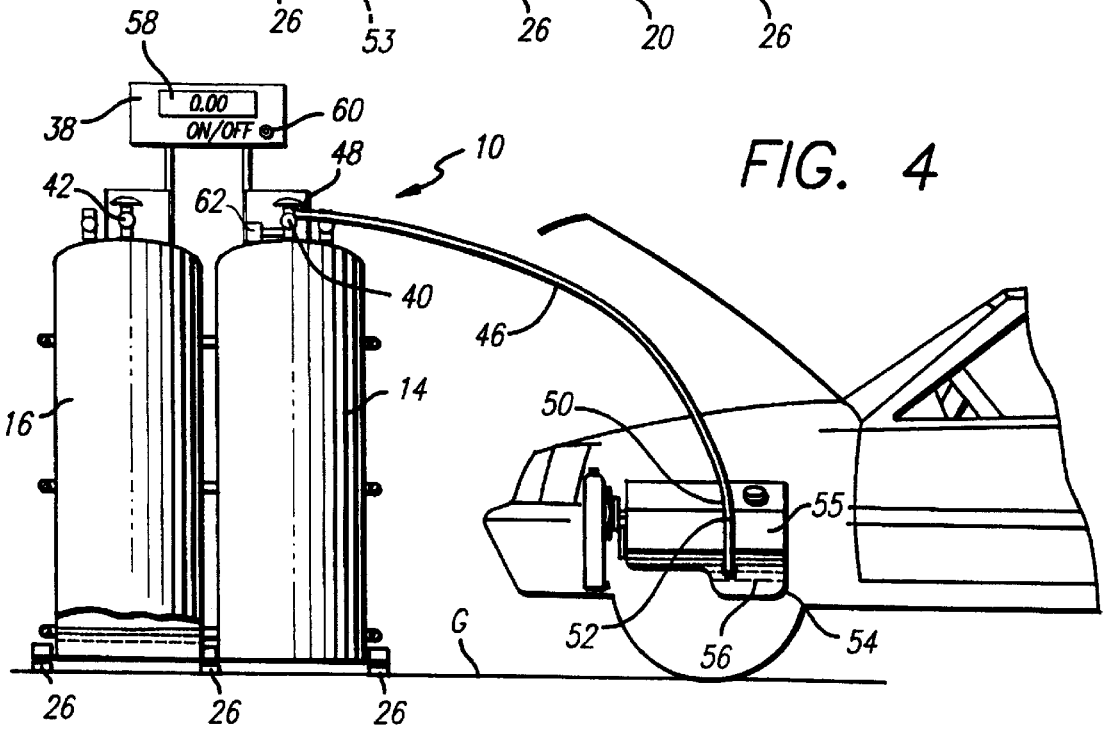
FIG. 4 is a front view of the automated fluid collecting and dispensing device in its weighing mode with its display unit set to zero, with a used fluid tube in a vehicle's oil sump being used to removed used oil from a vehicle.
Figure 5:
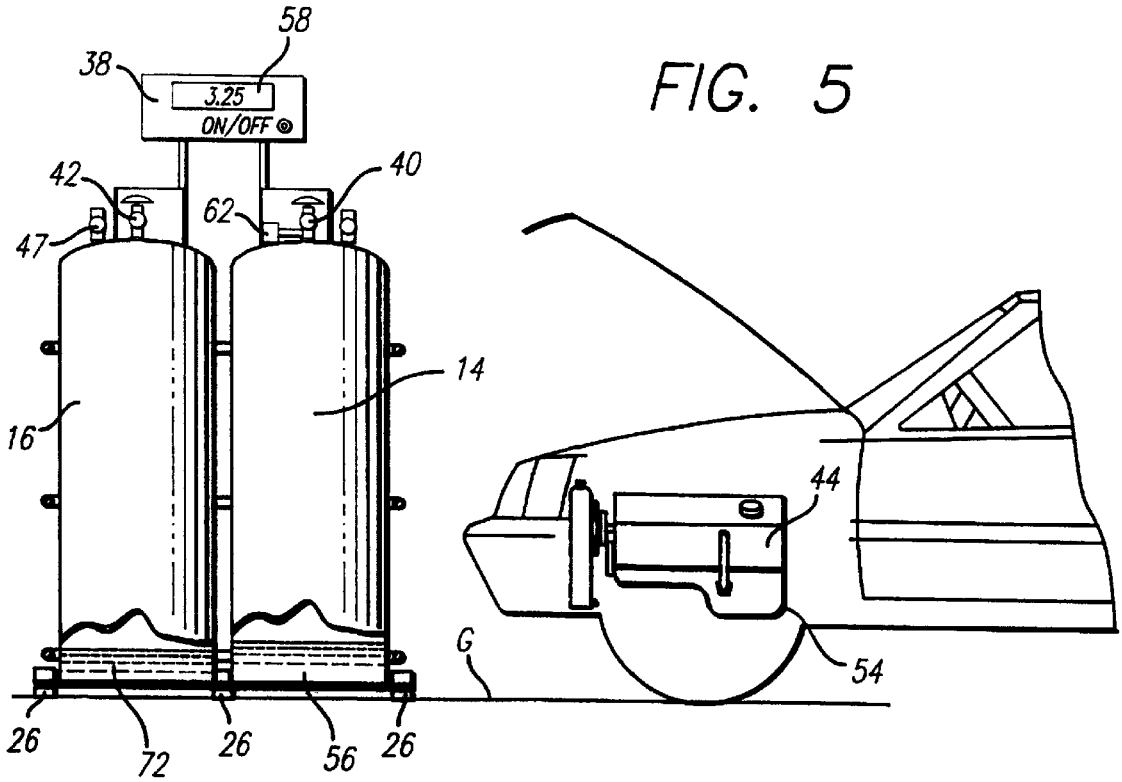
FIG. 5 is a front view of the automated fluid collecting and dispensing device in its weighing mode, after used oil is removed from the vehicle, with its display unit incremented to note the increased weight of the device resulting from the used oil being collected therein.
Figure 6:
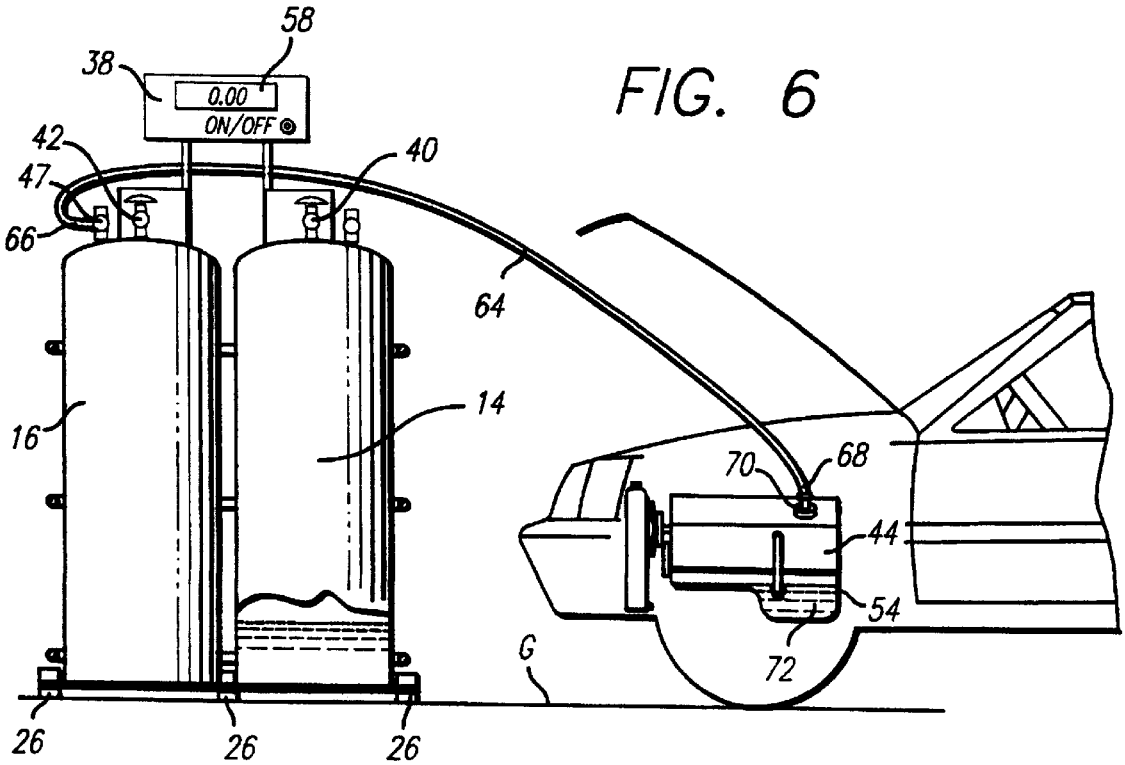
FIG. 6 is a front view of the automated fluid collecting and dispensing device in its weighing mode, after new oil is delivered to the vehicle through the new fluid tube, with the display unit decremented to zero, to indicate that an equivalent weight of new fluid as used fluid has now been delivered to the vehicle.

Referring now to FIGS. 4–6, the device 10 is shown used to carry out an oil change on a motor vehicle's motor 44. A used fluid hose 46 is connected at one end 48 to the used fluid valve 40 on the used fluid tank 14. Its other end 50 is placed down into the motor's 55 dipstick opening 52, and down into the motor's oil sump 54, into contact with the used motor oil 56 contained therein. The display device 38 can be reset to zero by activating an on/off switch 60. Referring to FIG. 4, the display device 38 is set to zero just prior to the used oil 56 being drawn out of motor's oil sump 54 through the used fluid tube 46, the used fluid valve 40, and into the used fluid tank 14. The used fluid tank 14 is adapted to be placed under a vacuum, such as 50 centimeters of mercury vacuum. Referring to FIG. 5, the used fluid tube 46 is removed after the used oil 56 is removed from the oil sump 54. The display means 38 will now display an incremented reading (e.g. 3.25), which indicates the increased weight made to bear on the load cells 26 as a direct result of the weight of the collected used oil 56 now stored in the used fluid tank 14. Referring now to FIG. 6, a new fluid hose 64 is connected at one end 66 to the new fluid delivery valve 47 on the new fluid tank 16, and has a second end 68 which is adapted to be placed in the motor's 44 oil fill port 70. The pressurized inert gas, such as nitrogen, carbon dioxide, helium, or others to provide motive force to move new oil 72 out of the new fluid tank 16, through the new fluid delivery valve 47, and the new fluid hose 64 and into the vehicle's motor 44 and back into the oil sump 54. The use of inert gases helps prevent oxidation and any potential fire hazards of storing the new fluids under pressure. Nitrogen at about 7.0 to 8.5 kg/cm (100–120 pounds per square inch) functions effectively, although other pressures also function.

Figure 4B:
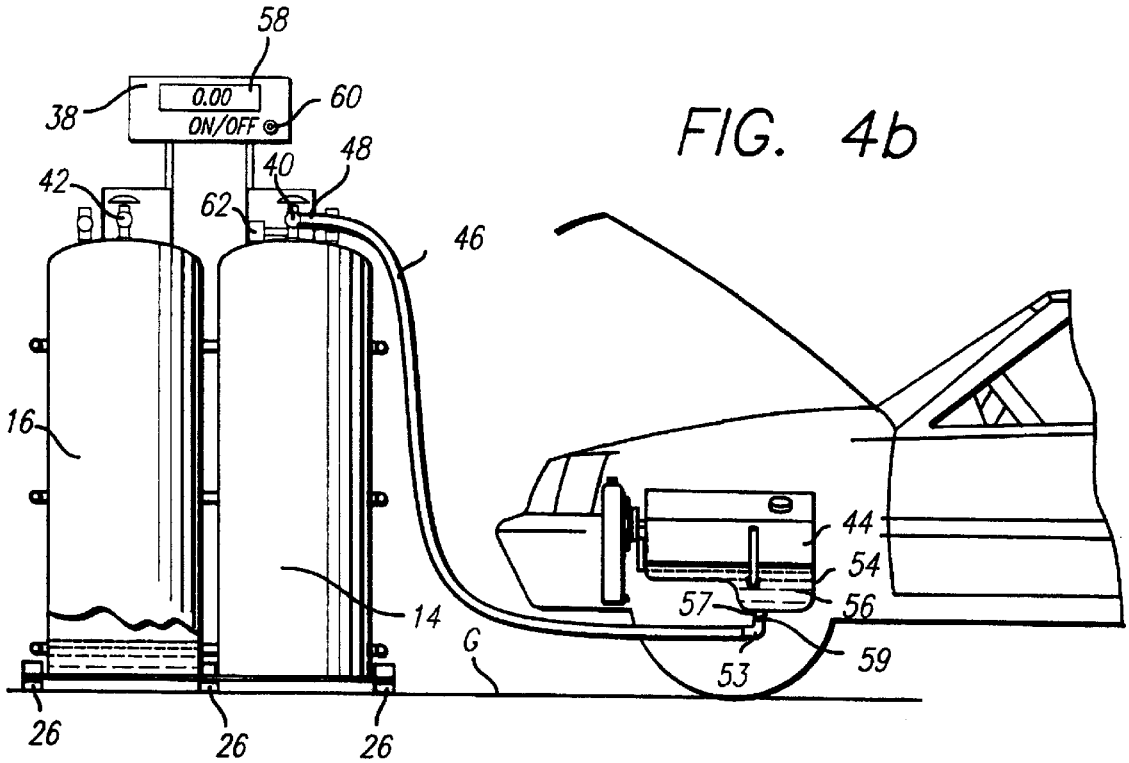
FIG. 4*b* is a view of the automated fluid collecting an dispensing device wherein its used fluid line is fitted with a connector for connection to the vehicle's oil pan valve.

In lieu of collecting the waste fluid through the waste fluid tube that is inserted through a vehicles dipstick opening 52 as is shown in FIG. 4, the waste fluid tube 46 can instead be fitted with a novel attachment 53, which is adapted to fluid tightly engage with a quick release fitting 59 fixed on the oil pan 57 of the oil sump 54 of the vehicle being serviced, as is shown in FIG. 4*b*.

After delivering an equal weight of new oil 72 as the weight of used oil 56 which was removed, the display means 38 decrements back to zero, indicating the loss of weight due to the delivery of new oil 72. If a user desires to add more new oil 72 than the amount of used oil 56 removed, (for example, if the motor oil level was low as determined by examining the dip stick) the user can continue to add additional new oil 72 until the display means is decremented below zero (not shown.)

Figure 7:
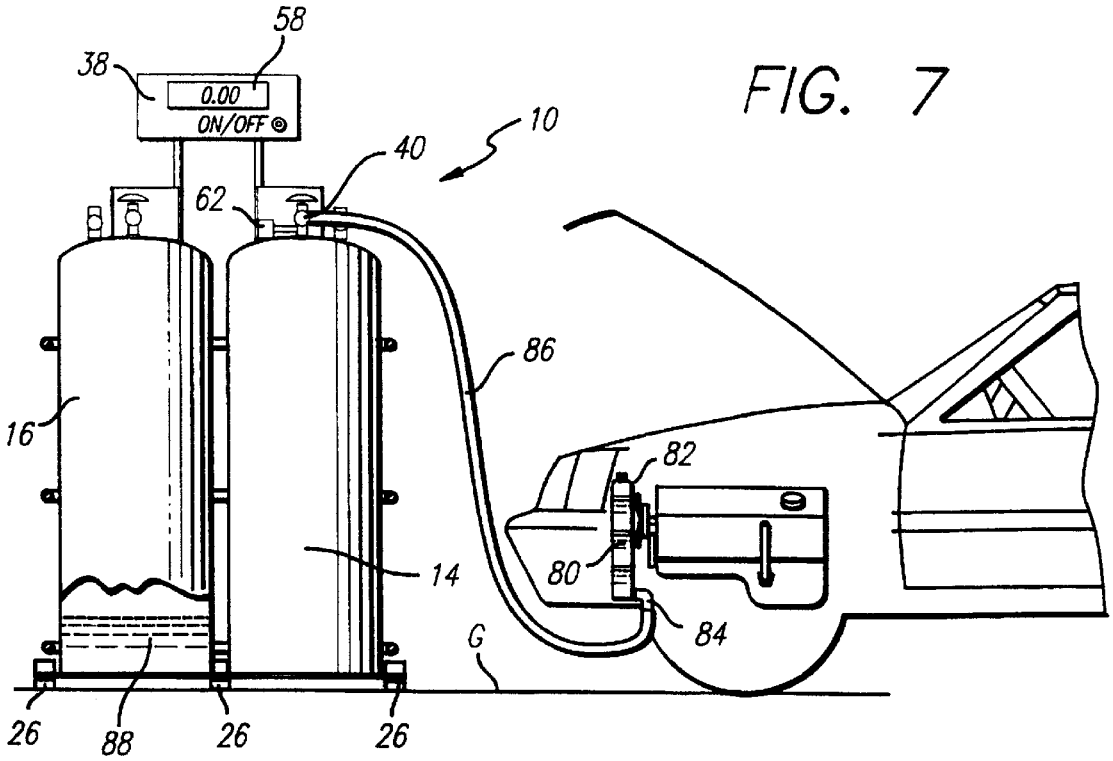
FIG. 7 is a front view of the automated fluid collecting and dispensing device in its weighing mode with a used fluid tube connected to a vehicle's radiator, removing used radiator fluid from the vehicle.
Figure 8:
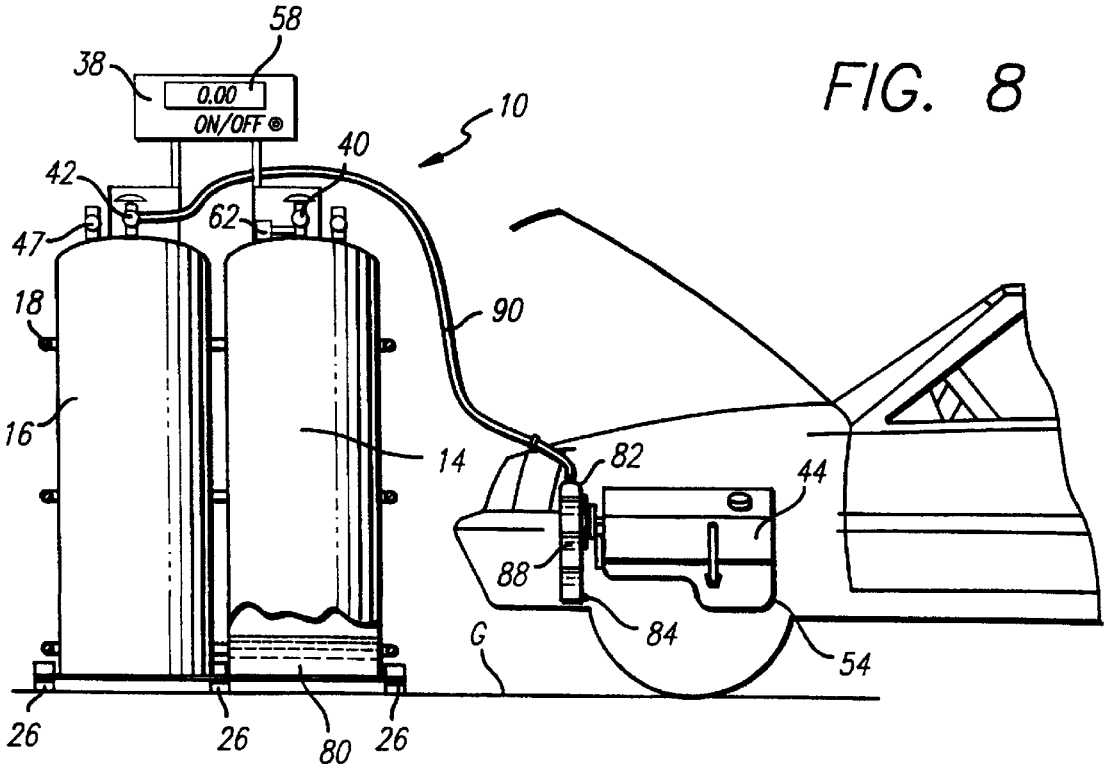
FIG. 8 is a front view of the automated fluid collecting and dispensing device in its weighing mode, after new radiator fluid is delivered to the vehicle through the new fluid tube.
Figure 9:
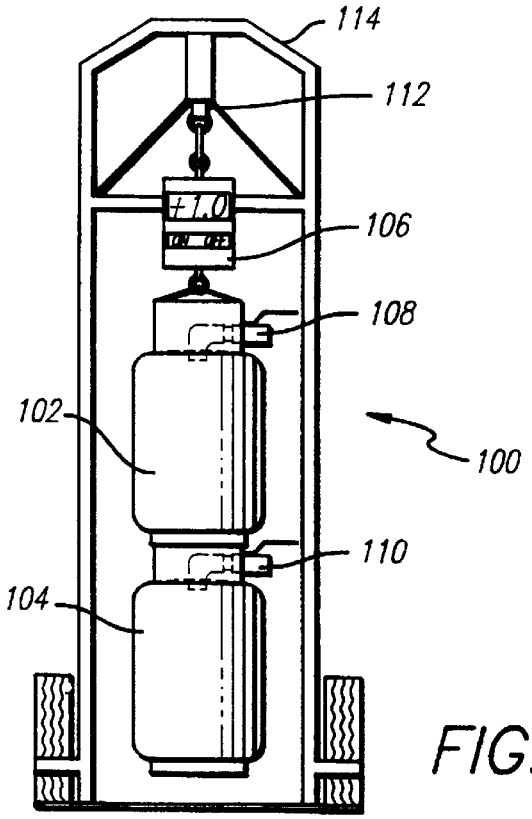
FIG. 9 is a front view of an alternate embodiment of the automated fluid collecting and dispensing device of the invention wherein the tanks hang from a weight scale.

Referring now to FIG. 7, the device 10 is shown being used to remove used radiator fluid 80 from a vehicle's radiator 82 through its drain valve 84. A used fluid hose 86 is connected to the drain valve 84 and the used fluid valve 40 on the used fluid tank 14. Again, the display means 58 is zeroed out prior to collecting used radiator fluid 80, but will increment upwardly as used radiator fluid 80 is drawn into the used fluid tank 14. FIG. 8 shows the device 10 being used to replenish the radiator 82 with new radiator fluid 88. A new fluid hose 90 is connected to the new fluid valve 42 on the new fluid tank 16. The display means 58 will decrement downwardly back to zero when an equal weight of new radiator fluid 88 as the used radiator fluid 80 collected is delivered.

While the device 10 has been described above with reference to changing a vehicles motor oil, and radiator fluid, the device 10 can be used with changing any number of fluids. To maintain the purity of the various used fluids collected, and new fluids delivered, the tank arrangement 12 are preferably designated to collect and deliver a certain designated fluid, i.e. a particular grade and brand of motor oil, radiator fluid, transformer fluid, and other fluids. The collected used fluids will be pooled with the same used fluids, and delivered to a used fluid recycler. Since the system helps prevent co-mingling of different used fluids, the value of the used fluid collect will be much higher since it can be reprocessed back into the high value product. Furthermore, since each used fluid container will be used to store one particular fluid and that fluid alone, this will eliminate any need to clean out the tank arrangement 12 of the device 10.

To provide for more full automation of the device, the used fluid valve 40 and the new fluid valve 42 can be controlled by the display means 58 such that the used fluid valve 40 will shut off when a vacuum detector 62 detects that vacuum has been lost in the used fluid tank, which signals that all the used fluid has been withdrawn from the used fluid container 14. Alternately, the used fluid valve 40 can be set to shut off when the display means 58 stops detecting a weight change for a predetermined time from the load cells 26 (indicating that all the used fluid has been collected). Likewise, the new fluid valve can be controlled by the display means 58 after the display means zero's out, indicating that the same weight of new fluid has been delivered as the weight of used fluid collected.

FIGS. 9–12 show an alternate embodiment of an automated fluid collecting and dispensing device 100. In this device, a used fluid tank 102 and new fluid tank 104 are suspended from a weight scale 106. Used fluid valve 108 and new fluid valve 110 are fitted on their respective used and new fluid tanks 102 and 104. The weight scale 106 hangs from a holding bracket 112 on a cart 114. Any and all weight overall weight changes occurring in the hanging tanks, such as from fluid being collected in the used fluid tank 102 and dispensed from the new fluid tank 104, will be displayed by the weight scale 106. In this manner, to use the system, the weight scale is zeroed out prior to being used. After a certain weight of used fluid is collected in the used fluid tank 102 and the scale 106 registers a certain weight, new fluid can be dispensed from the new fluid tank 104 until the weight scale returns to zero, indicating the same quantity of new fluid was delivered as used fluid was collected.

Figure 12:
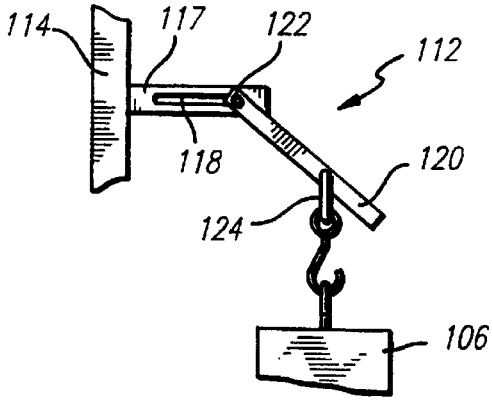
FIG. 12 is a detail in circled area 12—12 of FIG. 10, showing the raising and lowering mechanism for the scale and tanks.
Figure 10:
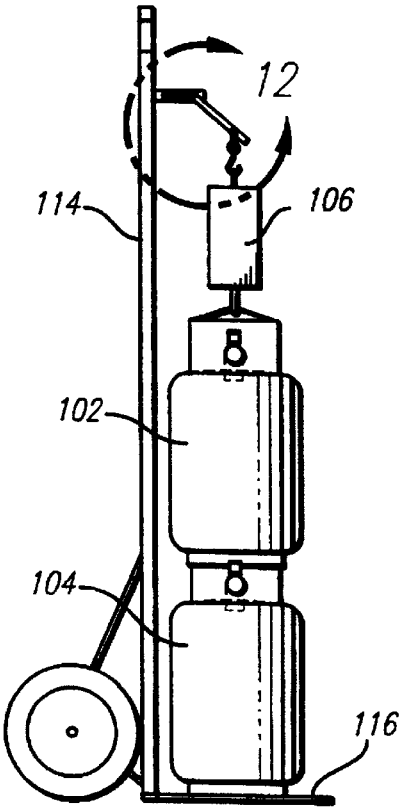
FIG. 10 is a side view of the device of FIG. 9, in its travel mode.
Figure 11:
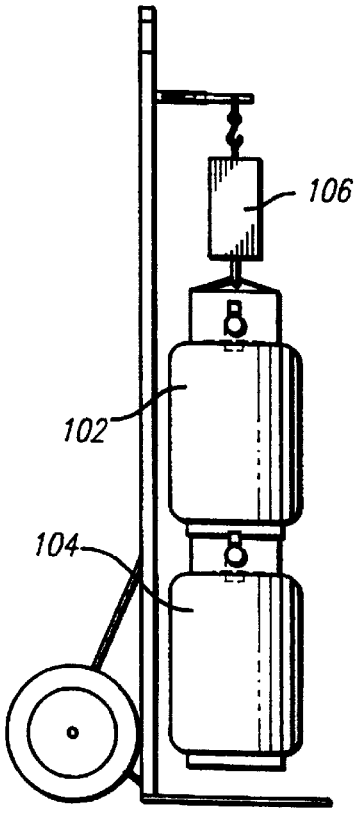
FIG. 11 is a side view of the device of FIG. 9, in its weighing mode.

Referring to FIGS. 10–12, one embodiment of the holding bracket 112 is shown, and is adapted to permit the scale 106 and its hanging tanks 102 and 104 to be easily moved between a travel mode, shown in FIG. 10 (where the weight of the tanks 102 and 104 are at least partially carried on a base 116 of the cart 114) so as not to exert weight on the scale 106), and a weighing mode, shown in FIG. 11 (where the weight of the tanks 102 and 104 and their contents are measured by the scale 106.) In one simple embodiment, the holding bracket 112 comprises a bracket tube portion 117 with a longitudinal slot 118 formed in its sides. The bracket tube portion 117 is attached near the top of the cart 114. A sliding portion 120 is sized to slidably fit into the bracket tube portion 117 and has a pivot slider 122 at a distal end closer to the cart 114 which fits in the longitudinal slot 118. A scale hanging ring 124 is positioned at a proximal end of the sliding portion, and the scale 106 hangs from it. Referring to FIGS. 10 and 12, the sliding portion 120 is pulled forward mostly out of the bracket tube portion 117 so that the sliding portion 120 hangs down, allowing the weight of the scale 106 and tanks 102 and 104 to be carried on the base 116 of the cart 114. Referring to FIG. 11, in the weighing mode, the sliding portion 120 is raised to a horizontal position and is pushed into the bracket tube 117 so that the full weight of the tanks 102 and 104 and their contents are detected by the scale. Of course, other mechanisms can be employed to raise and lower the tanks 102 and 104 to deploy the system to a travel and weighing mode.

Figure 13:
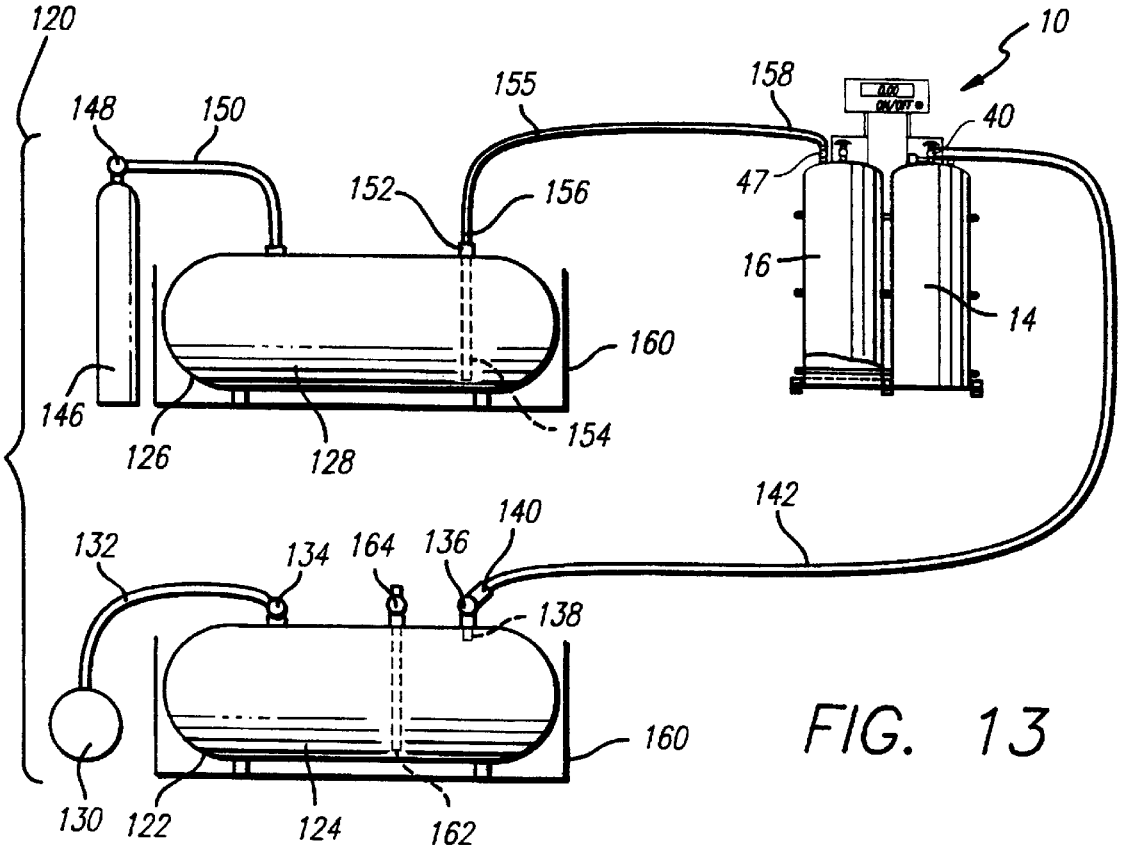
FIG. 13 shows, in schematic form, a first embodiment of the stationary primary and portable secondary portions of the system hooked up to empty the used fluid from the secondary used fluid container and to fill the secondary new fluid container with new fluid.

Referring to FIG. 13, after one or more fluid changes have been accomplished at the site of the vehicle or machinery, the device 10 can be wheeled back to the location of an optional stationary primary system 120, which can be placed wherever desired. The primary system 120 consists of a series of dedicated sealed used fluid containers 122 (only one of which is shown), for collection of particular used fluids 124 from the used fluid tanks 14, and a series of new fluid tanks 126 (only one of which is shown), containing a particular new fluid 128. The stationary used and new fluid tanks 122 and 126 have a substantially larger volume than the secondary used and new fluid tanks 14 and 16, i.e. in the range of 175 to 250 gallons. The stationary used fluid tank 122 is connected to a vacuum source 130, such as a vacuum pump or venturi generated vacuum, via a vacuum line 132. Ideally, a pressure sensor 134 will provide feedback as to the state of the vacuum in the primary used fluid tank 122, and thereby control the application of vacuum from the vacuum source 130, and thereby maintain a relatively constant vacuum in the primary used fluid tank 122. The primary used fluid tank 122 has a used fluid drawing valve 136 with a short stub pipe 138 extending into the stationary used fluid tank 122, and a inlet 140 connected to a primary used fluid suction hose 142. The terminal end 144 of the used fluid hose 142 is adapted to air tightly attach to the outlet 39 on the emptying valve 43 of the used fluid tank 14. When the used fluid drawing valve 136 is opened, the vacuum at the top space of the stationary used fluid tank 122 will thus vacuum the used fluid from the portable used fluid tank 14 via its secondary used fluid feed tube 45. As the used fluid is removed from the portable used fluid tank 14, the vacuum pressure in the portable used fluid tank 14 will be lowered to that of the stationary used fluid containers 122, and the secondary used fluid container 14 will be readied for receiving additional used fluid at the site of the vehicle or machinery.

The stationary new fluid container 126 has a constant source of inert gas feed to it, at a predetermined pressure. The inventor has found that a nitrogen gas cylinder 146 with a pressure regulator 148, piped via pipe 150 to the new fluid tank 126 is a convenient and low cost way to maintain a constant inert gas pressure in the stationary new fluid tank 126, regardless of the volume of new fluid 128 contained therein. For example, a nitrogen gas pressure of 100 to 120 $lbs/in^2$ (7.0–8.5 $kg/cm^2$) will provide ample pressure to rapidly convey the new fluid 128 from the stationary new fluid tank 126 to the portable new fluid tank 16 during it recharging, as will be described below. A new fluid outlet valve 152 is provided on the stationary new fluid container 126. The new fluid outlet valve 152 has a stationary new fluid feed tube 154 with an open end which extends to near the bottom of the stationary new fluid tank 126. A stationary new fluid supply hose 154 is connected at a first end 156 to the valve 152, and has a coupler 158 on its free end, which is adapted to fluid tightly connect with the inlet 51 on the valve 47 of the portable new fluid tank 16. When the portable new fluid tank 16 is returned to the site of the stationary portion 120 of the system, it remains loaded with a predetermined quantity of nitrogen gas, but at a lower pressure than the gas in the stationary new fluid tank 126. Due to the nitrogen gas pressure differentials, the nitrogen gas will continue to "push" the new fluid 128 from the stationary new fluid tank 126 to the portable new fluid tank 16 until the gas pressure in the portable new fluid tank 16 equals that in stationary new fluid tank 66. This feature ensures that the desire quantify of new fluid will automatically be loaded into the secondary new fluid tank 16, without constant monitoring by an attendant.

In order to provide extra safety, the primary used and new fluid tanks 122 and 126 are preferably located within safety tubs 160, which have an internal volume greater than that of the containers 122 and 126, and thus are available to catch the contents of used or new fluid tanks 122 and 126 in the event of leakage.

When the stationary used fluid container 122 is full, its used fluid is vacuum removed therefrom up through a primary used fluid container feed tube 162 through valve 164 through a hose (not shown) which a used fluid hauler will connect to his or her truck, again into a dedicated container, thereby retaining the segregation of the particular used fluid steams. The particular used fluids are then transportation to the recycler in a conventional manner. In the case of depleted stationary new fluid tank 126, they can be recharged via the new fluid outlet valve 152, or, alternately, through a separate opening (not shown).

Although only single pairs of used fluid primary-secondary containers and new fluid primary-secondary containers are shown, it is to be understood that any number of used and new fluid primary-secondary containers can be provided, to accommodate the requirements of the vehicle or machine user.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following the claims which follow.

What is claimed is:

1. An automated fluid collecting and dispensing unit for the collection of used fluid and for the delivery of new fluid to a fluid utilizing device, comprising:

a tank arrangement comprising a used fluid tank for collecting and storing used fluid and a new fluid tank for storing and delivering new fluid, the used fluid tank being adapted to be placed under vacuum in order to provide a motive force to move used fluid from the fluid utilizing device into the used fluid tank, the new fluid tank being adapted to carry pressurized inert gas to provide motive force to move the new fluid out of the new fluid hose means and into the fluid utilizing device, a used fluid valve means connected to the used fluid container, a used fluid hose means adapted to be connected at one end to the used fluid valve means on the used fluid tank and placed into contact at another end with the used fluid in the fluid utilizing device, a new fluid valve means connected to the new fluid container, and a new fluid hose means adapted to be connected at one end to the new fluid valve means on the new fluid tank;

a cart adapted to carry the tank arrangement, the cart having weight sensing means for determining any change in weight of the tank arrangement and any used fluid and new fluid contained therein, and display means to display any the change in weight of the tank arrangement and any fluids contained therein.

2. The automated fluid collecting and dispensing unit of claim 1 wherein the cart comprises:

a tank support plate with an upper surface and a lower surface, with the tank arrangement adapted to rest on the upper surface and with the weight sensing means positioned to extend below the lower surface; and wheel support means with wheels;

wherein the cart is adapted to support the tank arrangement in a travel mode and in a weighing mode, wherein in the travel mode the weight of the cart and the tank arrangement is carried on the wheels and off of the weight sensing means, and in the weighing mode the weight of the cart and the tank arrangement is carried on the weight sensing means and off of the wheels.

3. The automated fluid collecting and dispensing unit of claim 1, wherein the weight sensing means comprises load cells.

4. The automated fluid collecting and dispensing unit of claim 1, wherein the weight sensing means comprises a hanging scale and the cart includes an upper hanging bracket for suspension of the hanging scale, and wherein the tank arrangement hangs from the hanging scale so that any changes in weight in the tank arrangement and new and used fluids located therein can be readily detected.

5. The automated fluid collecting and dispensing unit of claim 1, wherein the display means is adapted to increment as used fluid is drawn into the used fluid tank, and to decrement as new fluid is delivered from the new fluid tank to the fluid utilizing device, so that when a reading of zero is reached, a user will know that a certain quantity of used fluid has been replaced with a like quantity of new fluid.

6. The automated fluid collecting and dispensing unit of claim 1, wherein the display means is adapted to display one of a weight of the new and used fluids, and a volume of the new and used fluids when the new and used fluids' density information is imputed.

7. An automated fluid collecting and dispensing unit for the collection of used fluid and for the delivery of new fluid to a fluid utilizing device, comprising:

a tank arrangement having a used fluid tank for collecting and storing used fluid and a new fluid tank for storing and delivering new fluid, the used fluid tank being adapted to be placed under vacuum in order to provide a motive force to move used fluid from the fluid utilizing device and into said used fluid tank, a used fluid valve means connected to said used fluid container, and a used fluid hose means adapted to be connected at one end to said used fluid valve means on said used fluid tank, and placed into contact at another end with the fluid in the fluid utilizing device, a new fluid valve means connected to said new fluid container, and a new fluid hose means adapted to be connected at one end to said new fluid valve means on said new fluid tank, and wherein said new fluid tank is adapted to carry pressurized inert gas to provide motive force to move the new fluid out of said new fluid hose means and into said fluid utilizing device;

load cells for determining any change in weight of said tank arrangement and any used fluid and new fluid contained therein;

a cart adapted to carry said tank arrangement, said cart having a tank support plate with an upper surface and a lower surface, with said tank arrangement adapted to rest on said upper surface and with said load cells positioned to extend below said lower surface, and wheel support means with wheels, wherein said cart is adapted to support said tank arrangement in a travel mode and in a weighing mode, wherein in said travel mode the weight of the cart and said tank arrangement is carried on said wheels and off of said weight sensing means, and in said weighing mode the weight of said cart and said tank arrangement is carried on said weight sensing means and off of said wheels; and display means adapted to increment as used fluid is drawn into said used fluid tank as measured by said load cells, and to decrement as new fluid is delivered from said new fluid tank as measured by said load cells, so that when a reading of zero is reached, a user will know that a certain quantity of used fluid has been replaced with a like quantity of new fluid.

8. An automated fluid collecting and dispensing unit for the collection of used fluid from, and delivery of new fluid to a fluid utilizing vehicle, machine or device, comprising:

(a) a portable secondary portion of the system for the collection of a particular used fluid from and for the delivery of a particular new fluid to a vehicle, machine or device, comprising;

a tank arrangement having a used fluid tank for collecting and storing used fluid and a new fluid tank for storing and delivering new fluid;

a cart adapted to carry said tank arrangement, said cart having weight sensing means for determining any change in weight of said tank arrangement and any used fluid and new fluid contained therein; and display means to display any said change in weight of said tank arrangement and any fluids contained therein, and a sealed secondary new fluid pressure container, with a new fluid conduit means, for delivery of a particular new fluid to a new fluid utilizer; and (b) a stationary primary portion of the system to ready the portable secondary portion of the system for reuse after its used fluid tank is full and its new fluid tank is empty, said stationery primary portion comprising a sealed primary used fluid pressure tank, connected to a vacuum generating source, and having a primary used fluid suction conduit for suctioning used fluid and air from said secondary used fluid tank when the primary and secondary used fluid tanks are connected, thus placing a vacuum on said secondary used fluid tank, and a sealed primary new fluid tank containing new fluid, said sealed primary new fluid tank having connected to it an inert gas supply for supplying pressurized inert gas pressure to said new fluid tank, and a primary new primary fluid delivery conduit for delivering new fluid to said secondary new fluid tank.

9. The automated fluid collecting and dispensing unit for the collection of used fluid and for the delivery of new fluid to a fluid utilizing vehicle, machinery or device of claim 8, further comprising a portable housing means to contain said secondary used and new fluid containers.

10. A method for the automated collection of different used fluids from and for the delivery of different new fluids to fluid utilizing vehicles, machinery and device which provides for the recovery and reuse of different used fluid streams used by vehicles, machinery and devices and the redelivery of new such fluid streams to vehicles, machinery and devices, said method comprising:

at a number of different sites, discharging each of said different used fluid streams into separate, dedicated and reusable and sealable secondary used fluid tanks, each of which bears specifically coded visual indicia to identify and contain one particular used fluid stream and no other, to thereby prevent cross-mixing of different used fluid streams, and determining the quantity of the discharged used fluid by weight, whereby each different used fluid stream is discharged into differently coded separate, dedicated and reusable and sealable secondary used fluid tanks;

collecting, and removing each particular used fluid stream from their separate dedicated and reusable and sealable secondary used fluid tanks from each of said different sites, and pooling them into a collective, particular primary used fluid tanks distinct and separate from any other different particular used fluid stream to continue to prevent cross-mixing of different used streams, thereby readying each said coded separate dedicated and reusable and sealable secondary used fluid tanks for receiving more of said particular used fluid stream without intervening cleaning and reconditioning of each said coded separate dedicated and reusable and sealable secondary used fluid tanks;

reprocessing said pooled, particular, used fluid streams to produce fluid products suitable for reuse;

delivering to said vehicles, machinery or devices a quantity of a series of new fluid streams from a series of specifically coded and dedicated secondary new fluid tanks which is generally equal to the weight of used fluid collected in said used fluid tanks, each containing a different and specific fluid stream, and replenishing said series of secondary new fluid tanks, as they are depleted, from primary new fluid tanks without intervening cleaning and reconditioning of said specifically coded and dedicated secondary new fluid tanks, wherein each specifically coded and dedicated used fluid tank is paired with a corresponding specifically coded dedicated new fluid tank, said pairing helping to ensure that the same type of a particular used fluid stream and new fluid stream will be collected from, and delivered to, respectively, a vehicle, machinery, or device, to thereby help ensure that a particular used fluid, and no other, is collected in its proper discharge container.

11. The method of claim 1, wherein each of said specifically coded and dedicated primary and secondary new and used fluid tanks contain visual indicia distinguishing them from any other of said specifically coded and dedicated primary and secondary new and used fluid tanks.

12. The method of claim 10, wherein the step of discharging of said different used fluid streams into each of said separate specifically coded and dedicated primary and secondary used fluid tanks takes place under the application of a vacuum, and the delivery of new fluid takes place under inert gas pressure.

13. The method of claim 10, wherein said plurality of said different used fluid streams are delivered to said reprocessing facilities in said segregated and separate discharge tanks.

14. The method of claim 10, wherein said plurality of said different used fluid streams are delivered to said reprocessing facilities in other segregated and separate discharge tanks, by emptying said used fluid streams into said other segregated and separate discharge tanks at the different sites of vehicles, machinery and devices.

15. The method of claim 10, wherein said replenishing of said segregated and separate new fluid tanks occurs at the different sites of the vehicles and machinery.

16. The method of claim 10, wherein said replenishing of said segregated and separate new fluid tanks occurs at sites other than the different sites of the vehicles and machinery.

17. The method of claim 10, wherein said used fluid tanks and said new fluid tanks are sealed pressure vessels capable of withstanding pressure and vacuum.

18. The method of claim 10, wherein the step of discharging each of the different used fluid streams into separate, dedicated and reusable and sealable tanks is accomplished by fluid tightly connecting a used fluid conduit between the vehicle and the separate, dedicated and reusable and sealable tanks, and applying a vacuum to the tank, thereby causing the used fluid stream to flow out of the vehicle, through the used fluid conduit, and into the tank in a fluid tight manner, thereby preventing anything but used fluid from entering the tank.

* * * * *

UNITED STATES PATENT AND TRADEMARK OFFICE

CERTIFICATE OF CORRECTION

PATENT NO. : 6,073,666
DATED : June 13, 2000
INVENTOR(S) : James E. Clark II

It is certified that error appears in the above-identified patent and that said Letters Patent is hereby corrected as shown below:

Column 9,
Line 16, after "display any" delete "the".
Line 54, change "imputed" to "inputted".

Column 11,
Line 8, change "device" to "devices"

Column 12,
Line 9, replace "claim 1" with -- claim 10 --.

Signed and Sealed this

Eighth Day of January, 2002

*Attest:*

*Attesting Officer*

JAMES E. ROGAN
*Director of the United States Patent and Trademark Office*